United States Patent [19]

Chen

[11] Patent Number: 4,561,330

[45] Date of Patent: Dec. 31, 1985

[54] PIPE WRENCH

[76] Inventor: Chao-Yang Chen, No. 585, San-Feng Rd., Feng-Yuan City, Taiwan

[21] Appl. No.: 667,538

[22] Filed: Nov. 2, 1984

[51] Int. Cl.[4] ..... B25B 13/22

[52] U.S. Cl. ..... 81/129.5; 81/133

[58] Field of Search ..... 81/129, 129.5, 133, 81/134, 139

[56] References Cited

U.S. PATENT DOCUMENTS

| | | | |
|---|---|---|---|
| 1,023,001 | 4/1912 | Bennetch | 81/133 |
| 1,094,221 | 4/1914 | Kuhns | 81/133 |
| 3,171,307 | 3/1965 | Jamal | 81/129.5 |
| 4,452,108 | 6/1984 | Irwin et al. | 81/129 |

*Primary Examiner*—James L. Jones, Jr.

*Attorney, Agent, or Firm*—Abelman Frayne Rezac & Schwab

[57] ABSTRACT

A wrench suitable for pipe work which includes a handle having two parallel arms, and a body pivotably mounted on the arms by means of a driving gear which passes through two holes provided on the arms, the holes are formed with internal teeth, a rack bar which includes a movable jaw at the forward end thereof and which has a portion slidably received in the body, wherein the driving gear is meshed with the teeth of the rack bar and which has the axis thereof transverse to the handle, when rotating the driving gear, the rack bar moves toward or away from a fixed jaw attached on the body, there are two sector pinions acting as the detent members mounted on the driving gear and operated cooperatively with internal teeth for permitting the uni-directional rotation of the driving gear with respect to the handle.

2 Claims, 4 Drawing Figures

PIPE WRENCH

BACKGROUND OF THE INVENTION

This invention is related to an improved adjustable pipe wrench, and particularly concerns a pipe wrench which includes an improved driving mechanism having enhanced strength.

Though there are a number of pipe wrenches which are known in the prior art, however, when using a wrench for heavy duty work, most of them were found too weak to bear a large acting force, so that, when using the wrench, the ratchet member, the driving wheel and the head were easily broken.

SUMMARY OF THE INVENTION

It is a general object of this invention to provide a pipe wrench with a more durable driving gear mechanism.

A second object of this invention is to provide a pipe wrench in which the handle may be operated in association with the driving gear.

A further object of this invention is to provide a pipe wrench which has a simplified structure and therefore the cost of the manufacture thereof is considerably reduced.

The pipe wrench forming the subject matter of this application includes a body having a fixed jaw, a handle having two parallel arms which is pivotably mounted with the body, a rack bar slidably mounted in the body and carrying a movable jaw, a driving gear located in the body and meshing with the rack bar, characterized in that: each of the parallel arms is provided with a opening and the openings axially aligned with respect to each other, each opening provided with internal teeth; the driving gear coaxially mounted across the openings; and a detent member mounted on the driving gear for engaging with the internal teeth for holding the driving gear and allowing rotation in only one direction.

According to a further feature of this invention, the detent member has two detenting surfaces, a controlling member mounted with respect to the detent member is capable of being operated to cause either detenting surface to be engaged with the internal teeth for holding one direction against rotation.

BRIEF DESCRIPTION OF THE DRAWINGS

For the purpose of illustrating the genius of this invention, the typical and preferred embodiments thereof are shown in the accompanying drawings, like numerals designate similar parts in which.

DETAILED DESCRIPTION OF THE PREFERRED EMBODIMENT

Figure 1:
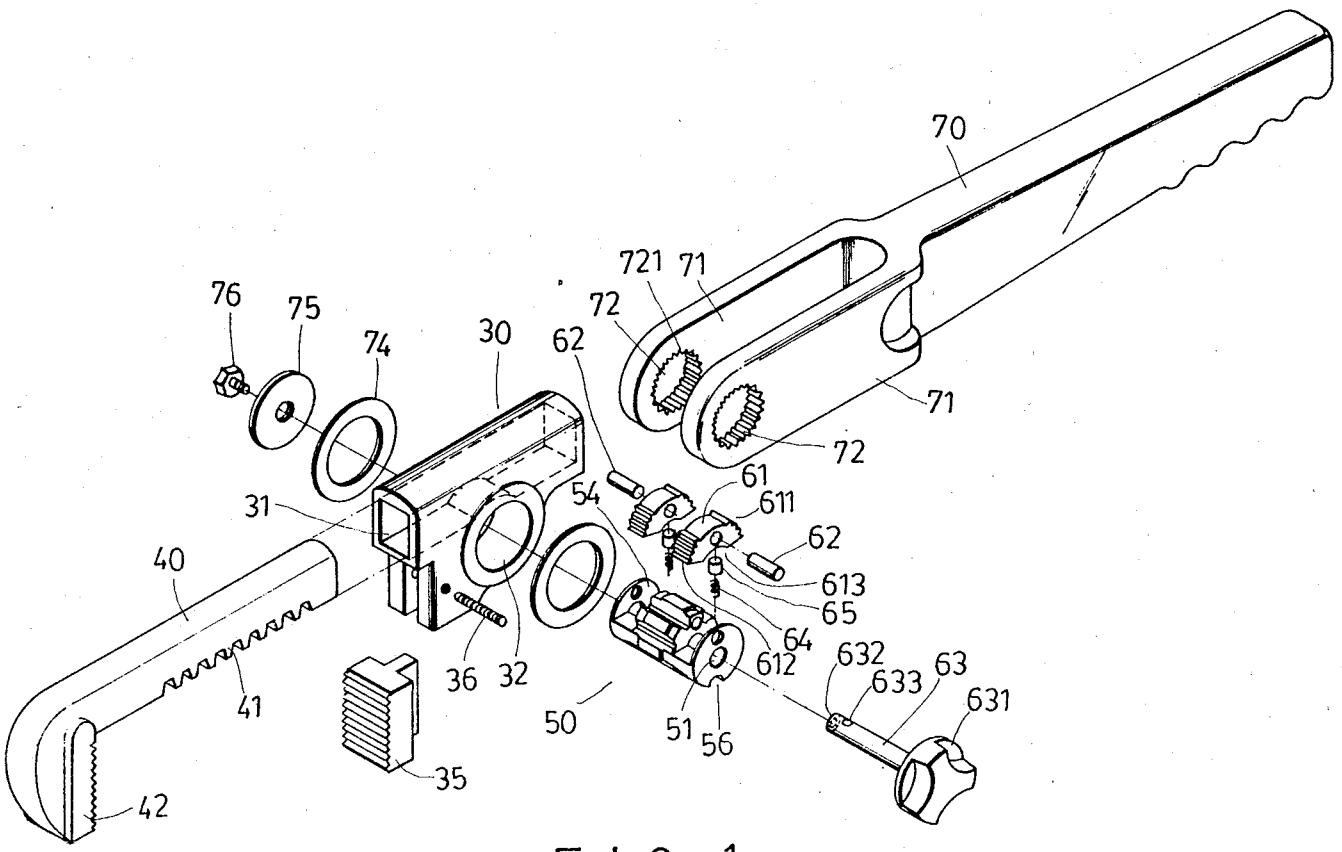
FIG. 1 is an exploded view of the pipe wrench according to a preferred embodiment of this invention.
Figure 2:
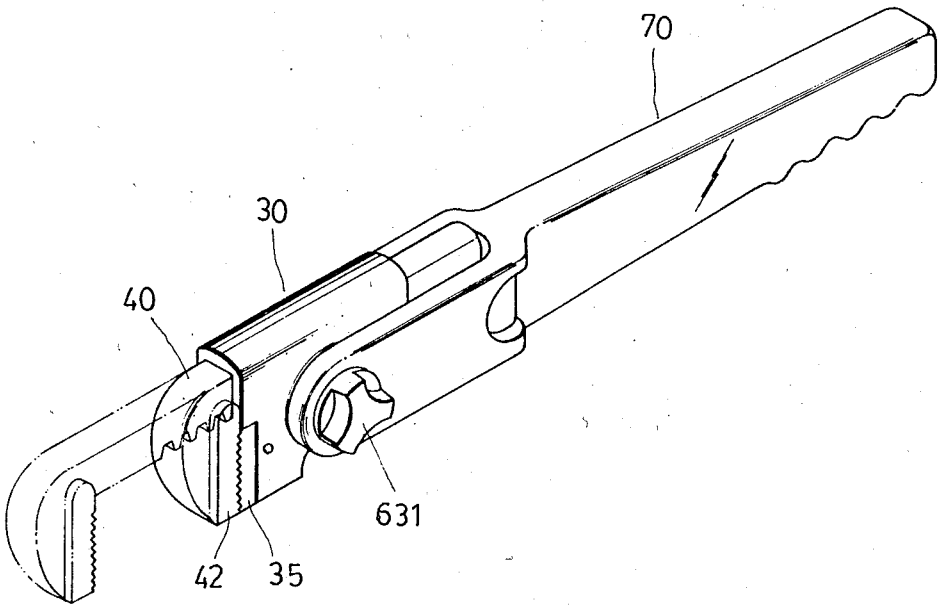
FIG. 2 is a perspective view of the pipe wrench as shown in FIG. 1, the dotted lines illustrate the movable jaw in an extended position to form a wrench opening.

Referring now to FIG. 1, the numeral 35 designates a fixed jaw adapted to be secured to a body 30 by means of a screw 36. A movable jaw 42 is formed on the forward end of a rack bar 40 which is slidable in a slot 31 of the body 30, so that the distance between the fixed jaw 35 and movable jaw 42 is adjustable. On the wall of the body 30 there is provided a hole 32 communicated with the slot 31, thus the teeth 41 of the rack bar 40 is accessible in the hole 32.

The operating handle 70 is provided with two arms 71 disposed in parallel with each other, each arm 71 is formed with an opening 72 having internal teeth 721, the operating handle 70 is pivotally mounted to the body 30, with two arms 71, 71 adjacent to the outer wall of the body 30, and the openings 72, 72 axially aligned with the hole 32.

A driving gear 50 has an axial length substantially corresponding to the distance between two arms 71, 71 of the handle 70 is axially disposed in the hole 32 of the body 30, an axial slot 56 is extended through the whole length thereof for permitting the teeth 41 to mesh with the driving gear 50 when assembling the body 30 and the driving gear 50, since the teeth 41 are accessible from the hole 32. The gear 50 meshes with the teeth 41 of the rack bar 40, so that when the rack bar 40 together with the body 30 is turned with respect to the handle 70 clockwisely or counterclockwisely, the opening defined between the movable jaw 42 and the fixed jaw 35 can be varied for receiving working pieces having different dimensions.

For controlling the uni-directional operation of the wrench, two sector pinions 61, 61 are provided for acting as two-way pawls of the teeth 721, as shown in FIG. 1, and mounted on two radial slots 54, 54 provided on the periphery surface of the driving gear 50 by two pins 62, 62 that pass through holes 55, 55 on the end surfaces of the driving gear 50. A certain pivoting angle of the same members is permitted because the radius of curvature of the sector pinion 61 is larger than the radius of the opening 72, the sector pinion 61 may have only one side thereof meshed with the internal teeth 721 and the other side disengaged with the teeth 721.

A controlling lever 63 associated with a manual wheel 631 is mounted in an axial hole 51 of the driving gear 50, there are two spring-loaded members 65, 65 accomodated in two slots 633, 633 (only one can be seen in the Figure) formed on the lever 63 at a distance, numerals 64, 64 designate the spring elements, the spring-loaded members 65, 65 are capable of being biassed against the arcuated bottom surface 613 of the sector pinions 61, 61 and enable the pinions to engage with the internal teeth 72. To adjust the wrench to a desired operating direction, the user may rotate the manual wheel 631 right or left, and the right side teeth 611 or left side teeth 612 will in turn mesh with the internal teeth 72 so that the rotation of the handle 70 with respect to the driving gear 50 in counterclockwise or clockwise direction is permitted.

To hold the driving gear 50 and cooperative elements in the hole 32, the cover plate 75 and washer 74 are provided to be mounted at two sides of the body 30 by means of a screw 76 to hold the gear 50 against transverse movement.

A screw 76 can be screwed into the axial hole 51 thereby securing the driving gear 50 in body 30.

When the body 30 is rotated about the driving gear 50, the jaws 35, 42 will be opened or closed depending the direction of rotation.

Figure 3:
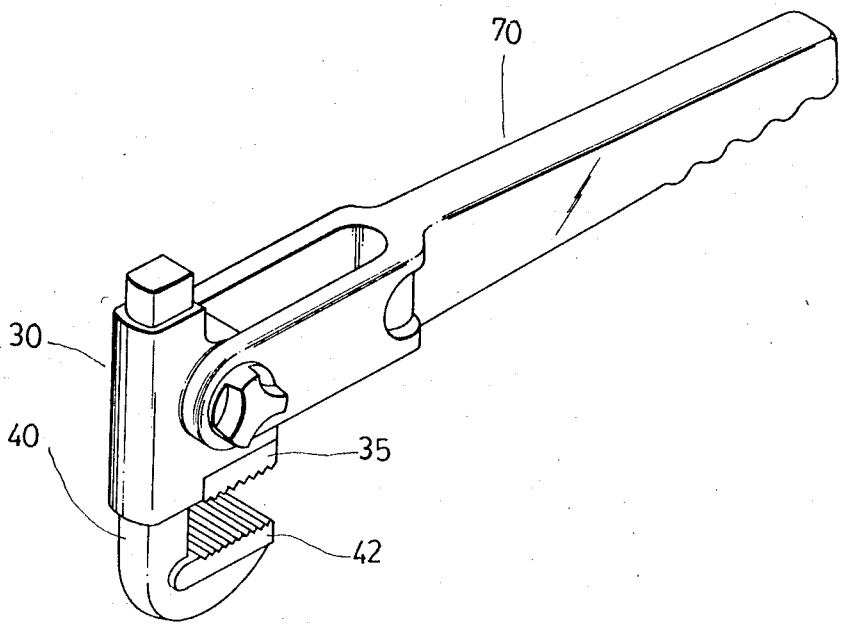
FIG. 3 is a perspective view showing the movable jaw rotated to the vertical position of the handle.

An operating position is illustrated in FIG. 3, the left side teeth 611 are engaged with the internal teeth 721 of the handle 70, an object (not shown), provided, having a diameter less than the distance between the fixed jaw 35 and the movable jaw 40 is inserted in the opening, by pushing the movable jaw 42 toward the handle 70, or turning the handle 70 clockwisely, the driving gear 50 may rotate clockwisely, therefore, the movable jaw 42 moves with the sliding of the rack bar 40 towards the fixed jaw 35 until it fits the object, when the handle 70 is turned clockwisely, the object will be wedged tightly between the fixed jaw 35 and movable jaw 42 and to be tightened when a torque is exerted on the object by the handle 70 clockwisely. In the same working position, if the object is required to be loosened, the user can turn the controlling lever 63 to make the right side teeth 612 engage with the internal teeth 72, then, the operating handle 70 is held against the counterclockwise rotation with respect to the body 30, so that, by turning the handle 70 the object can be rotated counterclockwisely.

It can be understood from FIG. 3 that the wrench can be used in a confined working space with less restrictions when being embodied according to the above features.

Figure 4:
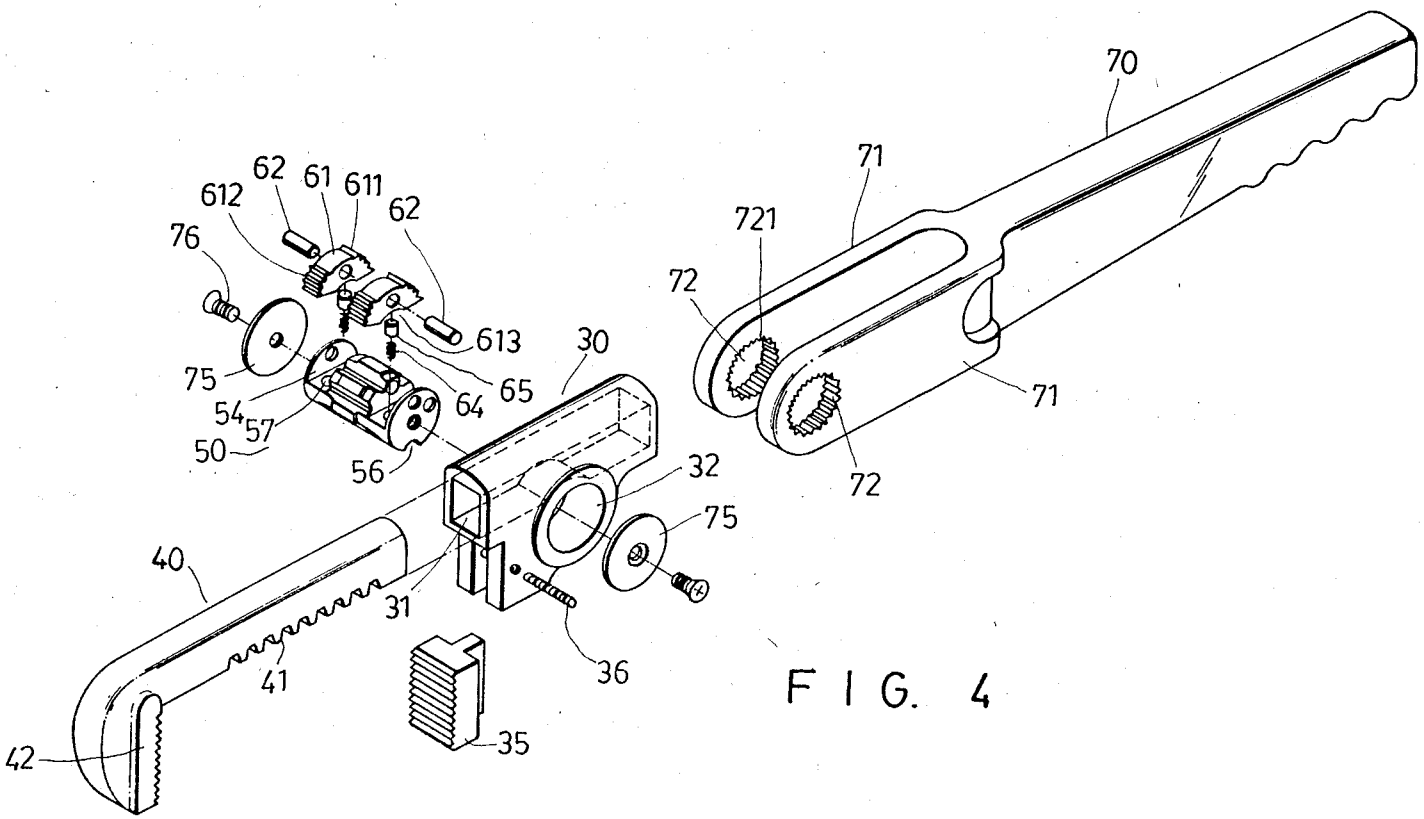
FIG. 4 is an exploded view of another embodiment of the pipe wrench according to this invention.

Referring to FIG. 4, there is another embodiment of this invention shown therein, the controlling lever is in absence in this embodiment, however a similar function can be obtained.

In this modified embodiment, the spring-loaded members 65, 65 are located on two holes 57, 57 formed on the left side of the central axis of the gear 50 and bias the left side teeth of the sector pinions 61, 61 to mesh with the internal teeth 721. Where a resistance of the movable jaw 42 and the fixed jaw 35 is encountered, such as when an object is gripped by these two jaws 35, 42, the body 30 then is prevented from clockwise rotation by the sector pinions 61, 61.

While the invention has been illustrated and described by means of the specific embodiments, it is understood that numerous changes and modifications may be made therein without departing from spirit and scope of the invention as defined in the appended claims.

I claim:

1. A pipe wrench including a body having a fixed jaw, a handle having two parallel arms being pivotably mounted with the body, a rack bar slidably mounted in the body and carrying a movable jaw, a driving gear located in the body and meshing with the rack bar, characterized in that: each of said parallel arms is provided with a opening and said openings are axially aligned with respect to each other, each opening is provided with internal teeth; said driving gear coaxially mounted across said openings; and a detent member mounted on said driving gear for engaging with said internal teeth and holding said driving gear against rotation in one direction.

2. A pipe wrench as claimed in claim 1, further characterized in that said detent member having two detenting surfaces, a controlling member mounted with respect to said detent member and capable of being operated to cause either detenting surface to be engaged with said internal teeth to prevent rotation in one direction.

* * * * *